US005784031A

United States Patent [19]

Weiss et al.

[11] Patent Number: 5,784,031

[45] Date of Patent: Jul. 21, 1998

[54] VERSATILE ANTTENNA ARRAY FOR MULTIPLE PENCIL BEAMS AND EFFICIENT BEAM COMBINATIONS

[75] Inventors: Anthony J. Weiss, Tel Aviv; David Lipman, Mivseret Zion; Yair Karmi, Rishon Lezion, all of Israel; Ilan Zorman; Haim Harel, both of Palo Alto, Calif.

[73] Assignee: Wireless Online, Inc., Los Altos, Calif.

[21] Appl. No.: 808,347

[22] Filed: Feb. 28, 1997

[51] Int. Cl.[6] ..... H01Q 3/22

[52] U.S. Cl. ..... 342/373

[58] Field of Search ..... 342/373, 371, 342/368, 372, 374

[56] References Cited

U.S. PATENT DOCUMENTS 4,882,588 11/1989 Renshaw et al. ..... 342/373

5,648,784 7/1997 Ruiz et al. ..... 342/373

OTHER PUBLICATIONS

C. A. Balanis, *Antenna Theory Analysis and Design*, Harper and Row, Publishers, Inc., 1982, pp. 679–685 and 698–699.

*Primary Examiner*—Gregory C. Issing

*Attorney, Agent, or Firm*—Townsend and Townsend and Crew LLP

[57] ABSTRACT

A base station including an antenna array that can be used to generate multiple well separated pencil radiation beams. Alternatively, these beams can be combined, without significant loss, to create a wide angle beam. Non-orthogonal beams (i.e. beams with significant spatial overlap) may be combined without significant field cancellation. The result is a single antenna array that can be used to transmit (or receive) different information on different beams (using every other beam) at the same frequency or alternatively it can be used for transmitting exactly the same information on all beams or on several beams that cover a sector.

15 Claims, 8 Drawing Sheets

VERSATILE ANTTENNA ARRAY FOR MULTIPLE PENCIL BEAMS AND EFFICIENT BEAM COMBINATIONS

BACKGROUND OF THE INVENTION

The present invention relates to multi-element antenna arrays and more particularly to schemes for generating non-orthogonal beams which can be combined without significant field cancellation.

Wireless communications systems have become pervasive. Examples include paging systems, voice telephony, data communications, etc. Typically, wireless communications systems accommodating a large number of users include a series of base stations dispersed throughout a region. Individual user stations, e.g., wireless telephone handsets, pagers, wireless modem units, interact with a particular base station depending on their current location. A backbone network further interconnects the base stations with each other and possibly with public networks such as the Public Switched Telephone Network or the Internet.

With the large scale of these systems, a base station may communicate simultaneously with a large number of user stations. Of course, the carrying capacity of each base station in terms of number of user stations in large part determines the revenue generation capacity of the system. The challenge is to increase this capacity as much as possible while maintaining communications quality.

Solutions to the capacity problem typically involve isolating the user stations from one another in some domain. For example, user stations may be separated from one another in frequency, so-called frequency division multiple access (FDMA). Another system called time domain multiple access (TDMA) permits multiple user stations to share the same frequency by allocating a time segment to each user station. Code division multiple access (CDMA) techniques are also available and involve assigning each user station a unique code which is mathematically combined with the signals exchanged between the base station and user station.

Even using all of these techniques, there are still constraints on the amount of information that can be exchanged between a base station and a large number of user stations in range while communicating within a fixed bandwidth. The amount of available bandwidth is in turn constrained by government regulations and in some cases the expense of obtaining licenses where spectral capacity has been auctioned.

Capacity may be further increased by segregating groups of user stations in the spatial domain. The number of base stations is increased, the cell covered by each base station is made smaller, and system radiated power is reduced so that communications in the cell covered by one base station do not interfere with other cells. This approach is however very expensive because mounting rights must be acquired for each of a very large number of base stations.

What is needed is a system for increasing the capacity of a large multi-user wireless communication system without greatly multiplying the number of base stations.

SUMMARY OF THE INVENTION

The present invention provides spatially isolated communications sharing a common frequency but operating from a single base station. Accordingly, system capacity is increased without increased bandwidth or the cost of installing multiple base stations to cover the area covered by one base station constructed in accordance with the present invention.

A linear array of antenna elements is excited so as to produce a desired radiation pattern including multiple non-orthogonal beams. Each beam covers a different angular sector of a region surrounding the base station. Alternating beams may use the same frequency but carry distinct signals without interference. Multiple beams may also be combined to carry the same signal without significant field cancellation. One application is a pager network.

In accordance with a first aspect of the present invention, apparatus is provided for generating a desired radiation pattern using a multiple element antenna array, the desired radiation pattern including a plurality of spatially overlapping beams. The apparatus includes a plurality of exciter inputs, each exciter input accepting an excitation signal for a corresponding beam of the desired radiation pattern, and a beamforming network that receives each the excitation signal and generates an output signal for each element of the array so that the array outputs the desired radiation pattern. An exciter input for every other beam of the desired radiation pattern includes a substantially 180 degree phase shifter to apply a substantially 180 degree phase shift prior to input to the beamforming network to minimize interference between adjacent beams of the desired radiation pattern.

In accordance with a second aspect of the present invention, a method is provided for exciting a multiple element antenna array to develop a desired radiation pattern including a plurality of spatially overlapping beams. The method includes steps of: generating a plurality of excitation signals, each excitation signal corresponding to one of the plurality of beams, phase shifting by substantially 180 degrees excitation signals of the plurality corresponding to alternating ones of the plurality of beams, and dividing each of the excitation signals among elements of the array in accordance with a Taylor Line-Source procedure to generate antenna element output signals.

In accordance with a third aspect of the present invention, in a multi-user communication system, a base station is provided for communicating with a plurality of user stations. The base station includes: a plurality of transmitters, each transmitter generating a distinct excitation signal to communicate with a user station of the plurality, a plurality of exciter inputs, each exciter input accepting one of the excitation signals for a corresponding beam of the desired radiation pattern, and a beamforming network that receives each the excitation signal and generates an output signal for each element of the array so that the array outputs the desired radiation pattern. An exciter input for every other beam of the desired radiation pattern includes a substantially 180 degree phase shifter to apply a substantially 180 degree phase shift prior to input to the beamforming network to minimize interference between adjacent beams of the desired radiation pattern.

The above discussion has been in terms of transmitters but the invention applies the same principle to receiving system design. A further understanding of the nature and advantages of the inventions herein may be realized by reference to the remaining portions of the specification and the attached drawings.

DESCRIPTION OF SPECIFIC EMBODIMENTS

Figure 1A:
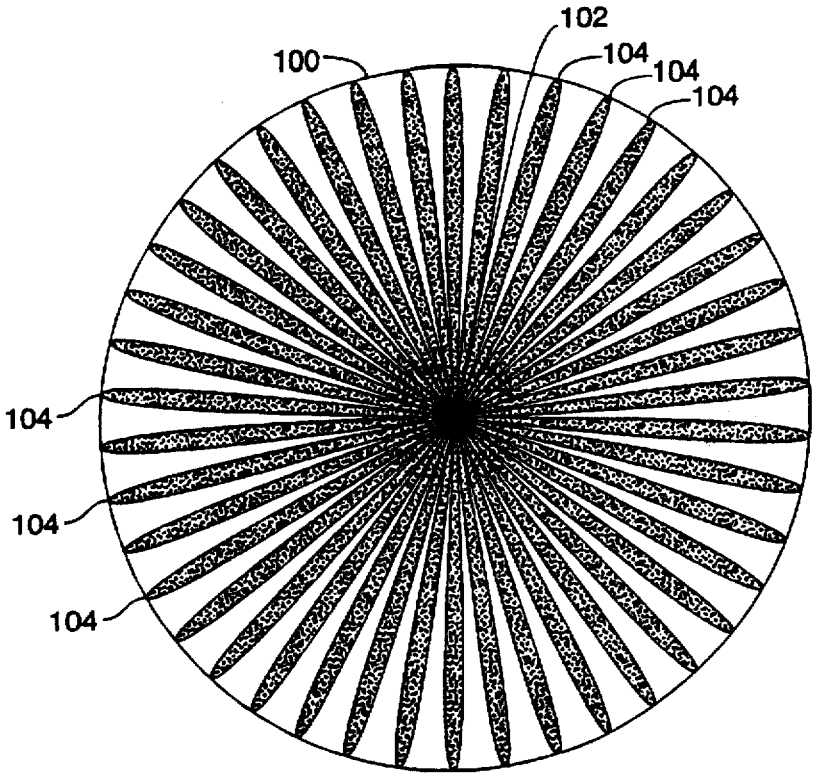
FIG. 1A depicts beam coverage of a region surrounding a base station in accordance with one embodiment of the present invention.

The present invention contemplates a multi-element antenna array which forms a desired radiation pattern. FIG. 1A depicts single frequency beam coverage of a region 100 surrounding a base station 102 in accordance with one embodiment of the present invention.

Base station 102 lies at the center of region 100. Base station 102 may have three linear arrays. Each array covers 120 degrees and radiates 28 distinct beams. In one embodiment, only alternating beams, e.g., 14 beams out of 28 beams may be used for simultaneously transmitting different signals on the same frequency. Thus, base station 102 emits 42 beams carrying distinct information.

The radiation pattern is depicted in simplified form to show the number of beams at a particular frequency. In one application base station 102 may emit 42 distinct signals at a first frequency and 42 distinct signals at a second frequency. Alternatively, as many of the 84 beams as desired may carry the same signal without substantial field cancellation. Also, the transmitter radiation pattern also indicates the directional pattern of receiver sensitivity.

Figure 1B:
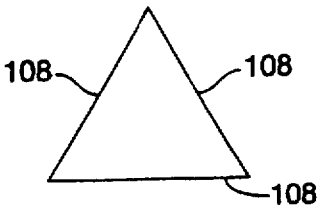
FIG. 1B depicts a top view of the arrangement of multiple element antenna arrays in an antenna tower in accordance with one embodiment of the present invention.

FIG. 1B depicts a top view of the arrangement of multiple element antenna arrays in an antenna tower in accordance with one embodiment of the present invention. Three multi-element antenna arrays 108 are arranged in a triangle. Each array 108 is responsible for providing a 120 degree section of the radiation pattern of FIG. 1A. Thus, each array 108 generates 28 beams, 14 at a first frequency and 14 at a second frequency. In FIG. 1B multi-element antenna arrays 108 are shown as touching but the spacing between the arrays will depend on the tower dimensions. Separate array sets may be provided for transmitting and receiving. Also, FIG. 1B shows that each array 108 is strictly vertical but this may be varied to optimize the radiation pattern for terrestrial communications.

Figure 2:
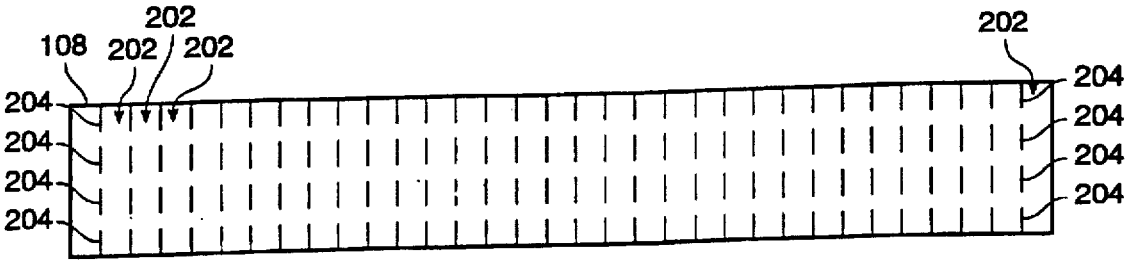
FIG. 2 depicts a front view of one of the multi-element antenna arrays of FIG. 1B.

FIG. 2 depicts a particular multi-element antenna array 108 for a transmitter application. Each of 32 antenna elements 202 includes a column of four vertical dipoles 204. The center taps of each dipole 204 of a given antenna element 202 are connected together. Antenna elements 202 are evenly spaced along a line. In a preferred embodiment optimized for transmission at 930 MHZ, the dipoles abut one another, the vertical dimension of array 108 is 90 cm, and the horizontal dimension is 520 cm. In a preferred embodiment optimized for reception at 901 MHZ, there are 16 antenna elements, each including a column of 8 dipoles. The horizontal dimension of array 108 is then 260 cm and the vertical dimension is 180 cm. The number of elements, number of dipoles in each element, dipole spacing, element spacing, and horizontal and vertical dimensions are design choices within the scope of the present invention.

Figure 3A:
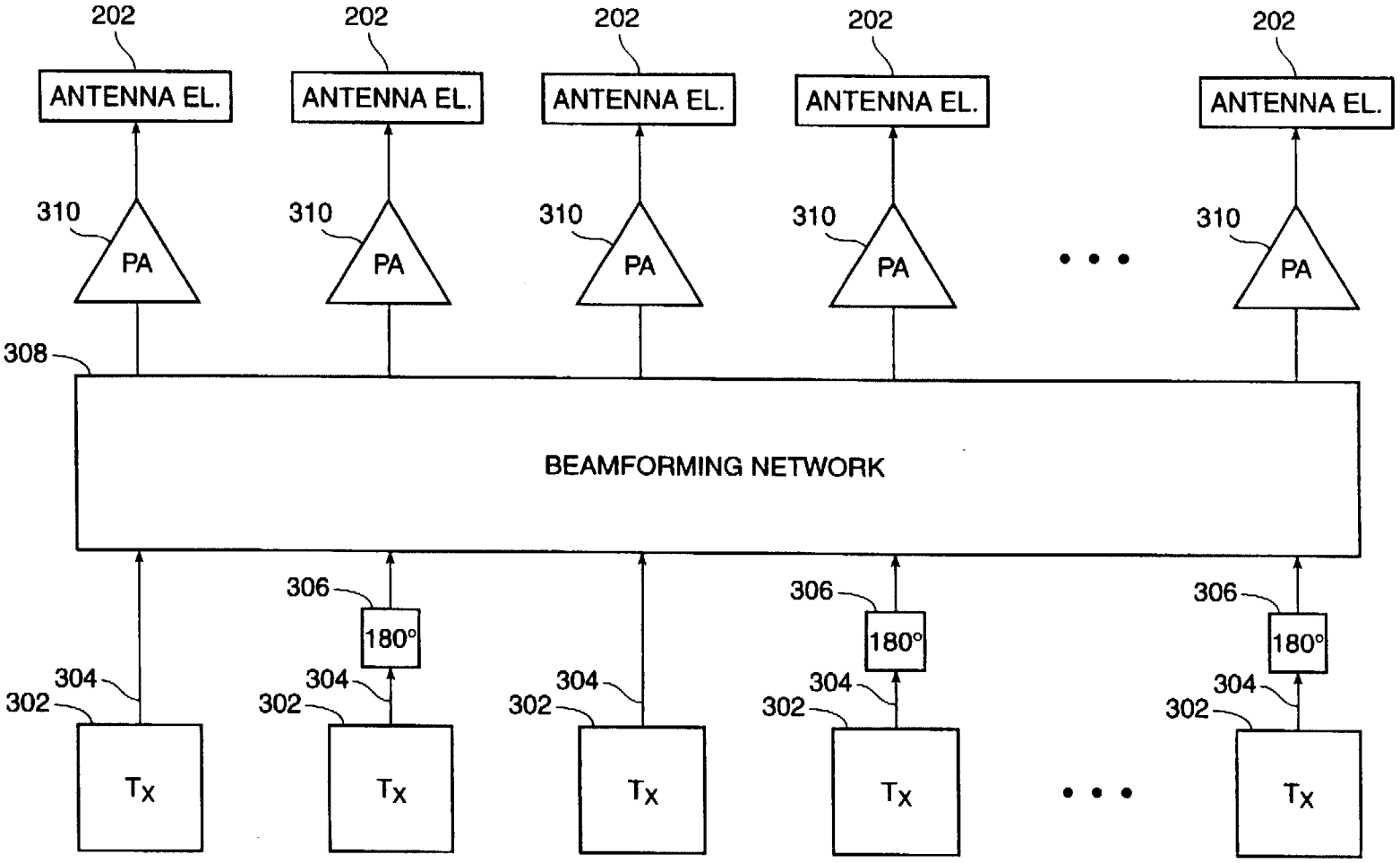
FIG. 3A depicts transmitter base station equipment as would be used to drive one of the multi-element antenna arrays of FIG. 1B.

FIG. 3A depicts a transmitter base station 300 for driving a particular multi-element antenna array 108 in accordance with one embodiment of the present invention. A plurality of transmitters 302 develop excitation signals 304. Each excitation signal 304 corresponds to one of the 28 beams of the radiation pattern of a particular multi-element antenna array 108. Excitation signals for alternating beams may carry different signals even at the same frequency. As compared to the single transmitter that would be used in an omni-directional scheme, the multi-element antenna array of the invention may provide a gain of 24 to 27 dBi. This allows transmitters 302 to be relatively low power transmitters implementable without bulky expensive power amplifiers and power supplies. As will be explained further below, the excitation signal for every other beam is subject to a 180 degree phase shift 306. A beamforming network 308 distributes the excitation signals 304 among antenna elements 202 to produce the desired radiation pattern. The operation of beamforming network 308 will be discussed in greater detail below. Each input to antenna element 202 is subject to power amplification by a power amplifier 310.

In an alternative embodiment, power amplifification is applied to the excitation signals input to beamforming network 308 rather than to the outputs of beamforming network 308. It has been found that this architecture provides improved rejection of intermodulation products over the one depicted in FIG. 3A. To achieve comparable output power, the output power of power amplifiers 310 must be increased to compensate for the insertion loss of beamforming network 308.

Figure 3B:
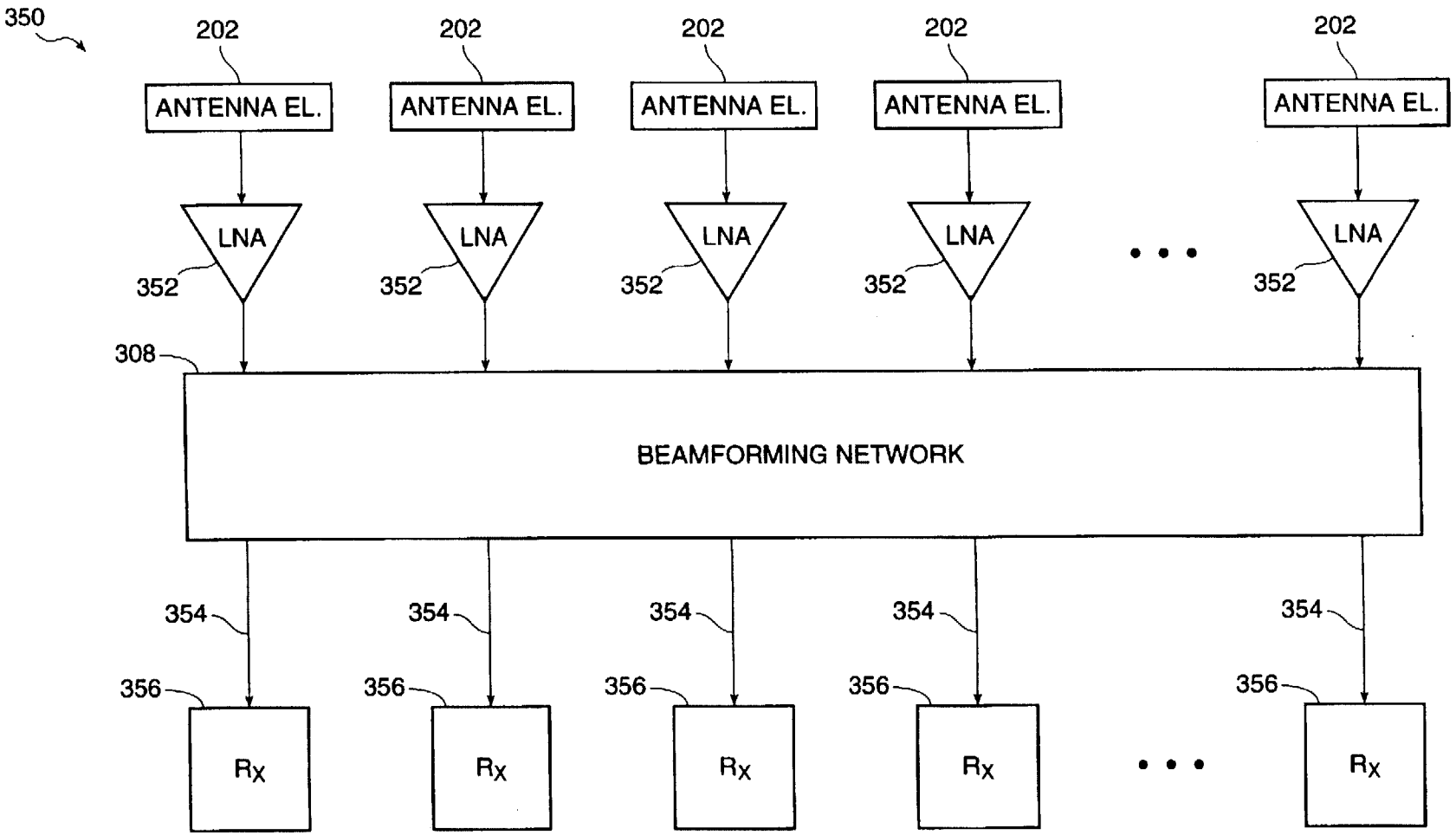
FIG. 3B depicts receiver base station equipment as would be used to drive one of the multi-element antenna arrays of FIG. 1B

FIG. 3B depicts a receiver base station 350 in accordance with one embodiment of the present invention. Beamforming network 308 and antenna elements 202 are similar to those depicted in transmitter base station 300. Here though, antenna elements 202 provide the inputs to beamforming network 308 through low noise amplifiers (LNAs) 352. Beamforming network 308 integrates the inputs from antenna elements 202 and develops beam signals 354 as collected along each beam. These signals are forwarded to receivers 356. In the preferred embodiment, the hardware for transmitter base station 200 and receiver base station is 250, although it will be appreciated that hardware sharing is possible within the scope of the present invention.

Figure 4:
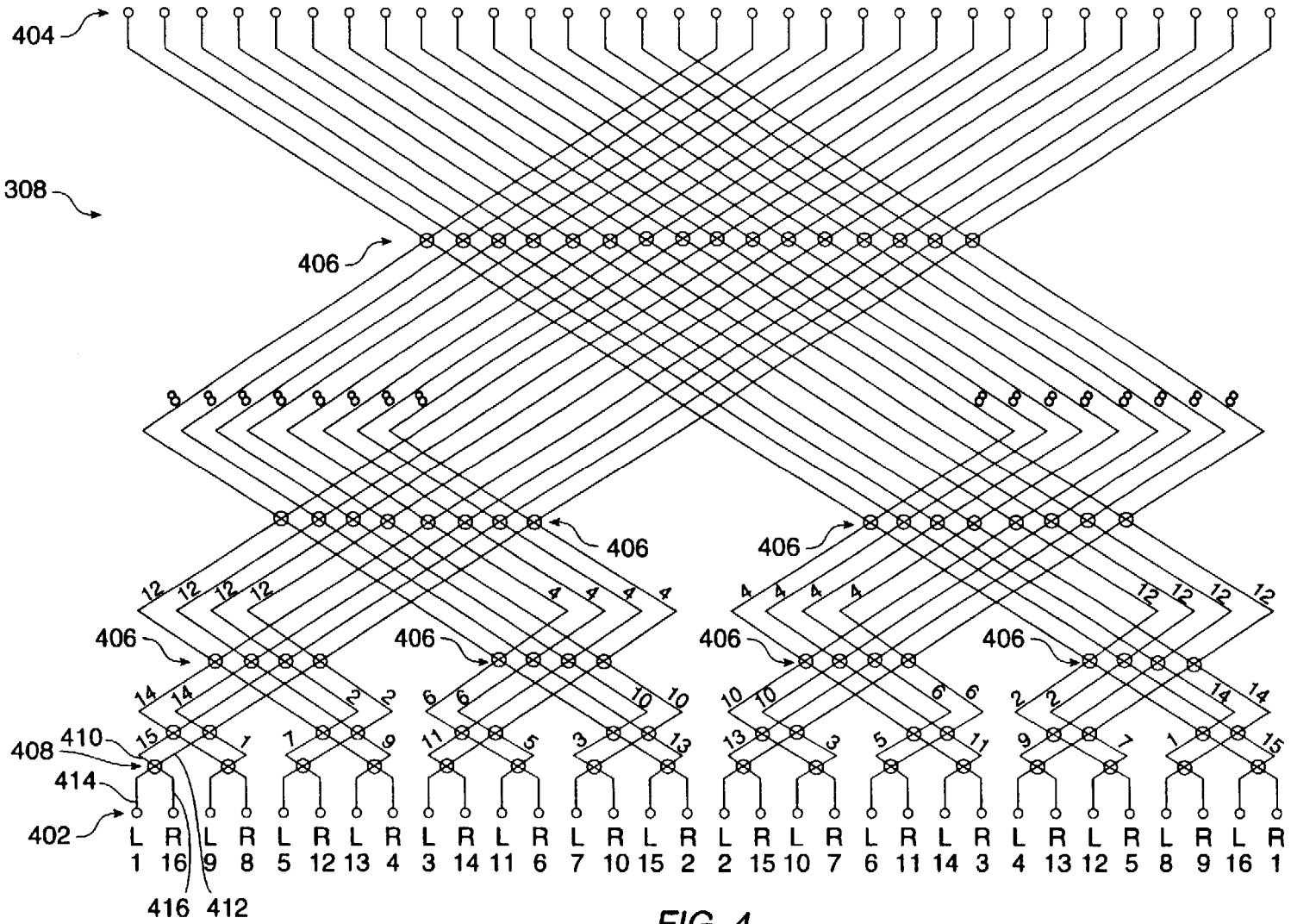
FIG. 4 depicts a beamforming network as would be used by the base station of FIG. 2.

FIG. 4 depicts beamforming network 308. Beamforming network 308 is preferably a Butler matrix which is an analog implementation of the Fast Fourier Transform. Beamforming network 308 is a passive network. Generally, the signal flow for the transmitter application is from bottom to top while the signal flow for the receiver application is from top to bottom. For convenience, the transmitter inputs will be referred to as simply "inputs," although these would be outputs in a receiver applications. Similarly, the transmitter output will be referred to as simply "outputs."

The depicted embodiment of beamforming network 308 has 32 inputs 402 and 32 outputs 404. Each output 404 corresponds to an antenna element 202. Each input 402 corresponds to the signal for a beam of a particular multi-element antenna array 108. The beams closest to the center of the 120 degree radiation pattern sector developed by a particular multi-element antenna array have their inputs labeled "L1" and "R1" respectively. Preferably, the inputs for beams "L15", "L16", "R15", and "R16" are left disconnected since these outermost beams would be attenuated. This is the reason for the discrepancy between the number of beams, 28, and the number of antenna elements, 32, in the preferred embodiment.

The structure of beamforming network 308 includes many passive hybrids 406. A particular passive hybrid 408 has its inputs and outputs labeled. The labeled distinction between inputs and outputs refers to the transmitter application and should be reversed for the receiver application.

Passive hybrid 408 has two outputs 410 and 412 and two inputs 414 and 416. Output 410 represents the sum of input 414 with no phase change and input 416 with a 90 degree phase change. Similarly, output 412 represents the sum of input 416 with no phase change and input 414 with a 90 degree phase change.

Some of the signal lines in FIG. 4 are marked with numbers, n. These indicate a phase shift of $n\pi/32$ radians. For example, a signal line marked by the number 10 indicates a phase shift of $10\pi/32$ radians.

The above has described a hardware implementation of the present invention. What follows is a discussion of the theory of operation and performance of a multi-element antenna array according to the present invention.

Figure 5:
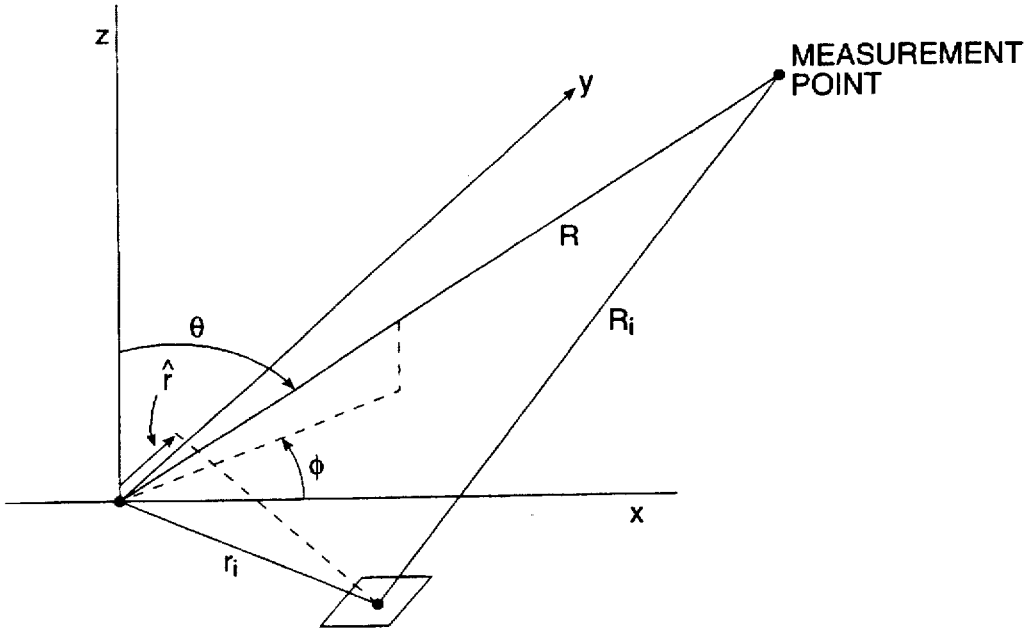
FIG. 5 depicts a coordinate system that helps illustrate the radiation pattern of the multi-element antenna array of FIG. 3.

Consider a linear array of antenna elements as depicted in FIG. 3. The far field of the ith element at a given measurement point is given by $$E_i = f(\theta,\phi)\frac{e^{-jkR_i}}{R_i} \tag{1}$$

where $f(\theta,\phi)$ is the element radiation pattern, $R_i$ is the distance of the measurement point from the ith element, $k=2\pi/\lambda$ is the wave number and $\lambda$ is the signal wavelength. Also note that $\theta$ is used to denote elevation and $\phi$ to denote azimuth and finally $j \triangleq \sqrt{-1}$. FIG. 5 shows this arrangement of the coordinate system.

Since we assume that the radiation is measured at a distance which is much larger than the array dimension we can use the approximation, $$R_i \cong R - \hat{r}\cdot r_i \tag{2}$$

where R is the distance of the measurement point from the origin of coordinates, $r_i$ is the vector from the origin of coordinates to the location of the sensor and $\hat{r}$ is a unit vector pointing from the origin towards the measurement location. Substituting (2) in (1) we obtain $$E_i = f(\theta,\phi)\frac{e^{-jkR}e^{jk\hat{r}\cdot r_i}}{R} \tag{3}$$

By superposition, the field generated by N elements together, with different complex weighting $a_i$ of each element, is $$E = \sum_{i=0}^{N-1} a_i E_i = f(\theta,\phi)\frac{e^{-jkR}}{R}\sum_{i=0}^{N-1} a_i e^{jk\hat{r}\cdot r_i} \tag{4}$$

Define the array factor $$F \triangleq \sum_{i=0}^{N-1} a_i e^{jk\hat{r}\cdot r_i} \tag{5}$$

which will be used in the following to describe the array radiation pattern. In order to further simplify the exposition we assume that the elements are equally spaced with a spacing denoted by d and they are all located on a straight line (the x axis). In this case we have $$r_i = id\hat{x} + 0\hat{y} + 0\hat{z} = id\hat{x} \tag{6}$$

where $$\hat{x}, \hat{y}, \hat{z}$$

are unit vectors in the directions of the coordinate system axis and $$\hat{r} = \sin\theta\cos\phi\,\hat{x} + \sin\theta\sin\phi\,\hat{y} + \cos\theta\,\hat{z} \tag{7}$$

We get $$\hat{r}\cdot r_i = id\sin\theta\cos\phi \tag{8}$$

and (5) becomes $$F(\theta,\phi) = \sum_{i=0}^{N-1} a_i e^{jkid\sin\theta\cos\phi} \tag{9}$$

and for $\theta=\pi/2$ equation (9) becomes $$F(\pi/2,\phi) = \sum_{i=0}^{N-1} a_i e^{jkid\cos\phi} \tag{10}$$

In order to point a beam towards direction $\phi_m$ the weights are selected as follows $$a_i = \omega_i e^{-jkid\cos\phi_m} \tag{11}$$

where $\omega_i$ is a real number equal to $|a_i|$.

Beamforming network 308 generates N beams simultaneously. To achieve a simple implementation of beamforming network 308, FFT techniques are used. These techniques are based on the formulation:

$$a_i/\omega_i = e^{-jkid\cos\phi_m} = e^{-j\psi(i)-j2\pi mi/N} \tag{12}$$

which leads to $$\cos\phi_m = \frac{\psi(i)}{kid} + \frac{2\pi m}{Nkd} = \frac{\psi(i)}{kid} + \frac{\lambda m}{Nd} \tag{13}$$

The last equation was obtained by using $k=2\pi/\lambda$. A useful choice for the first expression on the right is $$\frac{\psi(i)}{kid} = -\frac{(N-1)\pi}{kdN} = -\frac{(N-1)\lambda}{2dN} \quad (14)$$

Substituting (14) into (13) we get $$\cos\phi_m = -\frac{(N-1)\lambda}{2dN} + \frac{\lambda m}{Nd} = \frac{\lambda}{d}\ \frac{(2m-N+1)}{2N} \quad (15)$$

Note that if d=λ/2 we get $$[\cos\phi_0, \cos\phi_1, \ldots \cos\phi_{N-1}] = 1/N[-(N-1), -(N-3), \ldots (N-1)] \quad (16)$$

In other words, we have N beams in the interval between 0 and π.

This formulation results in a simple hardware design using the Butler matrix such as is shown in FIG. 4. Further information about Butler matrix networks is given in Robert J. Mailloux, *Phased Array Antenna Handbook*, Artech House, Inc., 1994, the contents of which are herein incorporated by reference.

If the output signal of the ith antenna element is denoted by $y_i$ the mth beam is formed by $$B_m = \sum_{i=0}^{N-1} y_i a_i = \sum_{i=0}^{N-1} y_i \omega_i e^{-j\psi(i)} e^{\frac{-j2\pi mi}{N}} = \sum_{i=0}^{N-1} \tilde{y}_i e^{\frac{-j2\pi mi}{N}} \quad (17)$$

where $$\tilde{y}_i = y_i \omega_i e^{-j\psi(i)} \quad (18)$$

Note that the last equation in (17) requires N complex multiplications (or phase shifts) for generating a single beam $B_m$. For generating N beams $B_0, B_1, \ldots, B_{N-1}$ one needs $N^2$ multiplications. However, due to its special form Equation (17) can be implemented by FFT. This technique reduces the number of multiplications (phase shifts) from $N^2$ to $N\log_2 N$.

The side lobes of the various beams can be reduced at the expense of beam broadening by choosing proper weights $\omega_i$. This is also called tapering. In a preferred embodiment weights are chosen using the Taylor Line-Source (Tschebyscheff Error) procedure as described in C. A. Balanis, *Antenna Theory Analysis and Design*, Harper and Row, Publishers, Inc., 1982, the contents of which are herein incorporated by reference. This technique yields side lobes that are 30 dB below the main lobe.

Figure 6A:
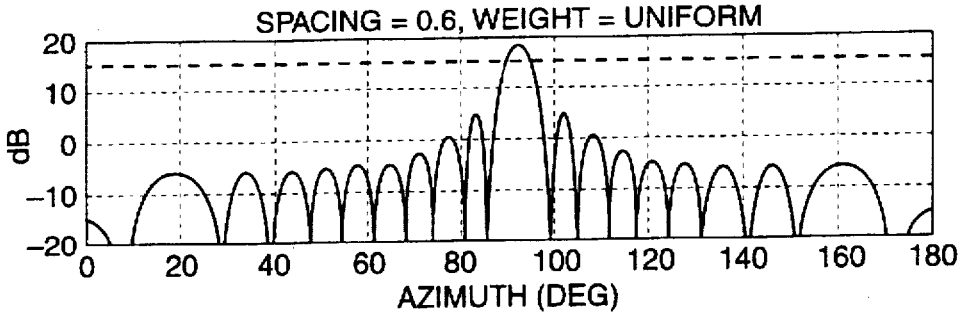
FIG. 6A (PRIOR ART)
FIG. 6A depicts the radiation pattern for a particular beam in a multi-element antenna array wherein uniform weights are assigned to each element.
Figure 6B:
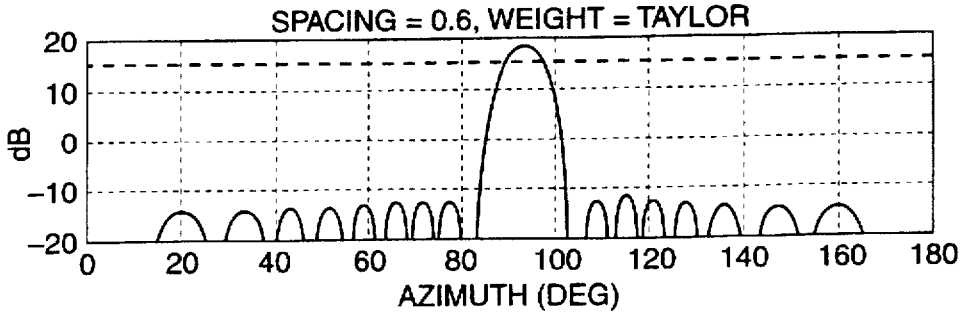
FIG. 6B (PRIOR ART)
FIG. 6B depicts the radiation pattern for a particular beam in a multi-element antenna array wherein Taylor weighting is used to assign weights to each element.
Figure 7:
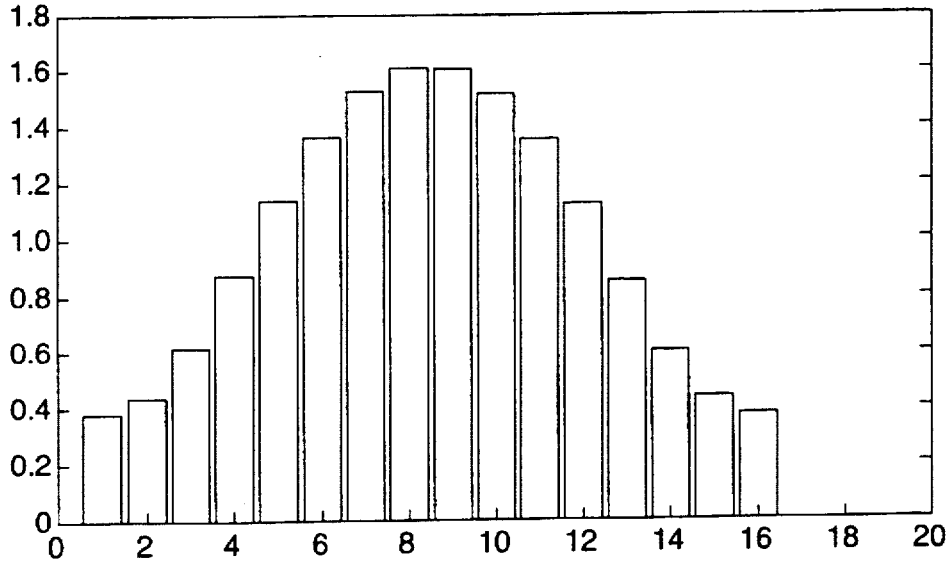
FIG. 7 (PRIOR ART)
FIG. 7 shows the weighting used to develop the radiation pattern of FIG. 6B.

FIG. 6A depicts the radiation pattern for a beam $B_7$ in a 16 beam system wherein uniform weights are assigned to each antenna element 208. FIG. 6B depicts the radiation pattern for beam $B_7$ wherein Taylor weighting is used to assign weights to each element 208. Note that as side lobes reduce, the main lobe broadens. FIG. 7 shows the weighting value $\omega_i$ assigned to each element I to develop the radiation pattern for beam $B_7$ of FIG. 6B.

Figure 8A:
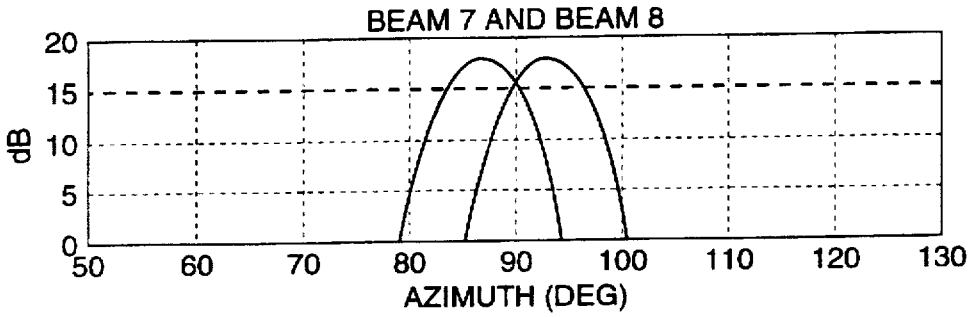
FIG. 8A (PRIOR ART)
FIG. 8A depicts the radiation pattern created by two adjacent beams using Taylor weighting.
Figure 8B:
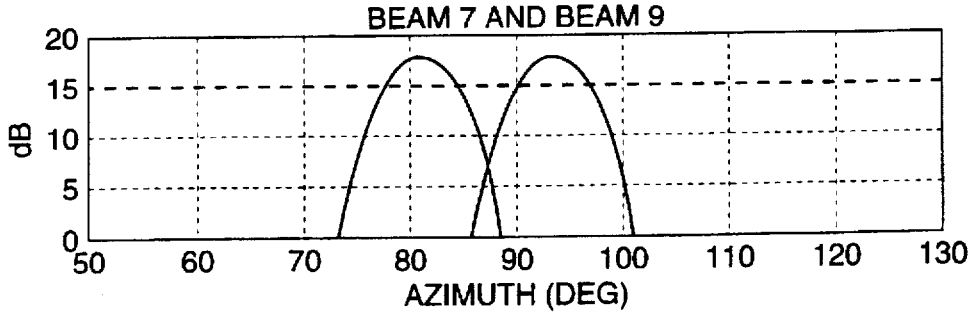
FIG. 8B (PRIOR ART)
FIG. 8B depicts the radiation pattern created by two non-adjacent beams using Taylor weighting.
Figure 9A:
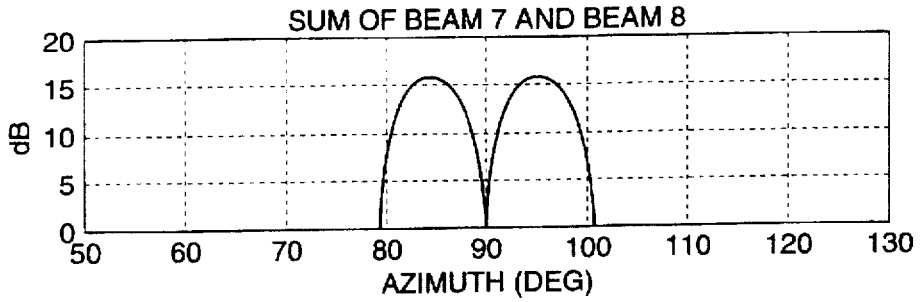
FIG. 9A (PRIOR ART)
FIG. 9A depicts the sum of the radiation patterns created by two adjacent beams using Taylor weighting.
Figure 9B:
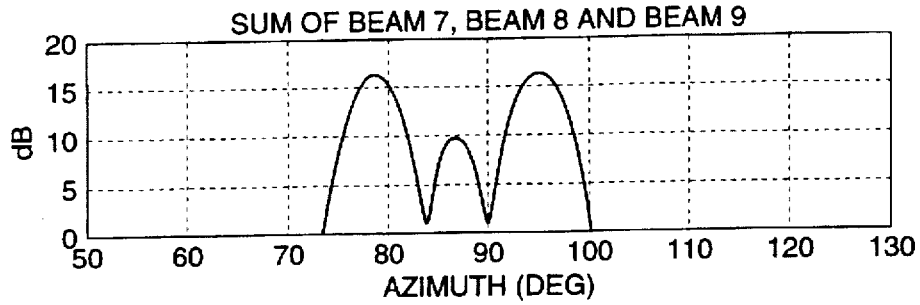
FIG. 9B (PRIOR ART)
FIG. 9B depicts the sum of the radiation patterns created by three adjacent beams using Taylor weighting.

FIG. 8A shows the main lobes of the radiation patterns for beams $B_7$ and $B_8$ FIG. 8B shows the main lobes of the radiation pattern for beams $B_7$ and $B_9$. Note that beam $B_7$ and beam $B_8$ overlap while $B_7$ and $B_9$ are well separated. It is clear that beam $B_7$ and beam $B_9$ are sufficiently separated and to be used to transmit different information using the same frequency. On the other hand beam $B_7$ and $B_8$ overlap significantly. They cannot be used together unless they transmit exactly the same signal. However, if they do transmit the same signal, field cancellation results as can be appreciated from FIGS. 9A–9B which show the combination of $B_7$ and $B_8$ as well as the combination of $B_7$, $B_8$, and $B_9$.

Figure 10A:
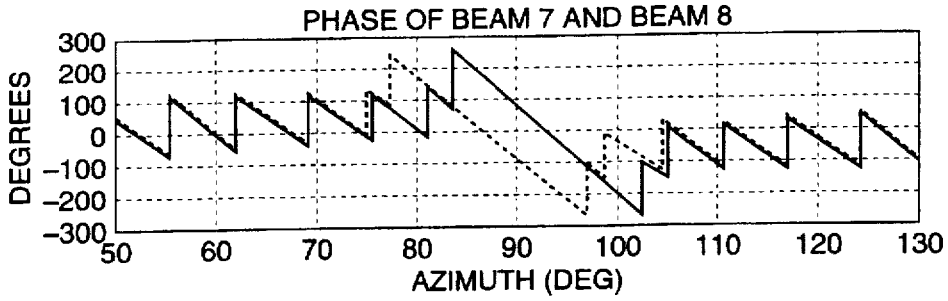
FIG. 10A (PRIOR ART)
FIG. 10A the phase of the radiation pattern of two adjacent beams using Taylor weighting.
Figure 10B:
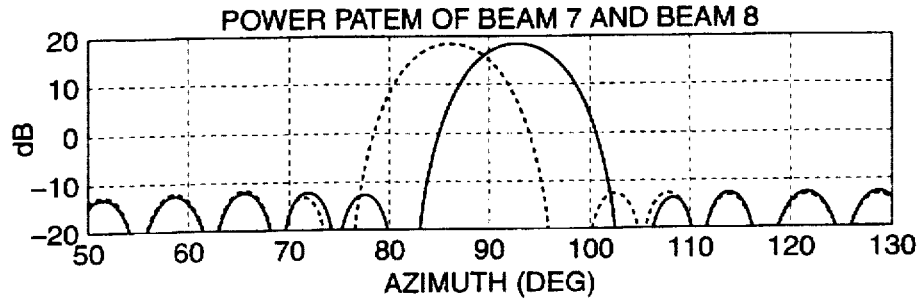
FIG. 10B (PRIOR ART)
FIG. 10B depicts the magnitude of the radiation pattern of two adjacent beams using Taylor weighting.

FIG. 10A shows the phase of $B_7$ and the phase of $B_8$, and indicates that there is a phase difference of 180 degrees. Therefore simple transmission with both beams at once will result in destructive interference and reduced field intensity. FIG. 10B shows the magnitudes for the two beams.

The present invention solves this problem by introducing 180 degree phase shifts between any two adjacent beams. For example, if it is desired to use all beams for simultaneous broadcasting, the even beams ($B_0, B_2, B_4, \ldots$) is excited with a signal that is shifted 180 degrees relative to the signal exciting the odd beams ($B_1, B_3, B_5, \ldots$). The same principle is used when it is desired to use only few beams for transmitting the same signal, and the beams are adjacent.

Figure 11A:
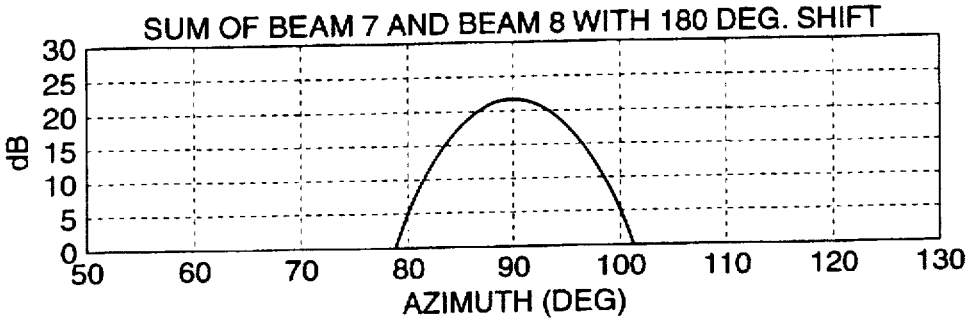
FIG. 11A depicts the sum of the radiation patterns created by two adjacent beams using Taylor weighting and applying 180 degree phase shifts to alternate beams in accordance with one embodiment of the present invention.
Figure 11B:
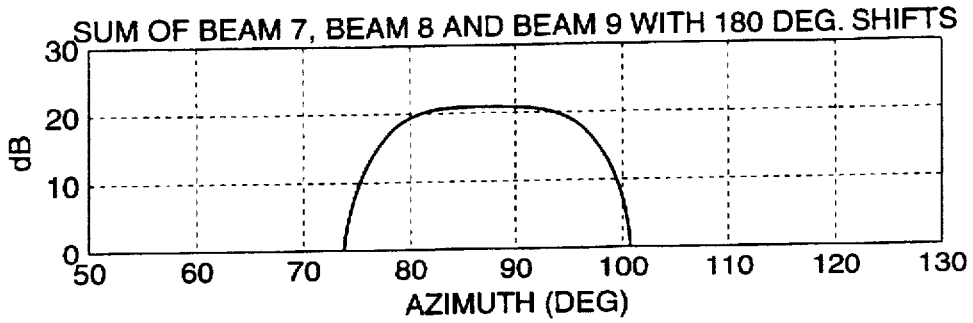
FIG. 11B depicts the sum of the radiation patterns created by three adjacent beams using Taylor weighting and applying 180 degree phase shifts to alternate beams in accordance with one embodiment of the present invention.

FIG. 11A depicts the sum of the radiation patterns created by two adjacent beams using Taylor weighting and applying 180 degree phase shifts to alternate beams in accordance with one embodiment of the present invention. FIG. 11B depicts the sum of the radiation patterns created by three adjacent beams using Taylor weighting and applying 180 degree phase shifts to alternate beams in accordance with one embodiment of the present invention. As can be seen, there is negligible field cancellation. Alternating beams may carry identical signals or distinct signals at the same frequency. It is of course understood that the same principles apply to signal reception.

In the foregoing specification, the invention has been described with reference to specific exemplary embodiments thereof. It will, however, be evident that various modifications and changes may be made thereunto without departing from the broader spirit and scope of the invention as set forth in the appended claims. Many such changes or modifications will be readily apparent to one of ordinary skill in the art. The specification and drawings are, accordingly, to be regarded in an illustrative rather than a restrictive sense, the invention being limited only by the provided claims and their full scope of equivalents.

What is claimed is:

1. Apparatus for generating a desired radiation pattern using a multiple element antenna array, said desired radiation pattern including a plurality of spatially overlapping beams, said apparatus comprising:

a plurality of exciter inputs, each exciter input accepting an excitation signal for a corresponding beam of said desired radiation pattern;

a beamforming network that receives each said excitation signal and generates an output signal for each element of said array so that said array outputs said desired radiation pattern; and an exciter input for every other beam of said desired radiation pattern including a substantially 180 degree phase shifter to apply a substantially 180 degree phase shift prior to input to said beamforming network to minimize interference between adjacent beams of said desired radiation pattern.

2. The apparatus of claim 1 wherein at least two of said beams share a common frequency and have different excitation signals.

3. The apparatus of claim 1 wherein all of said beams share a common frequency and have different excitation signals.

4. The apparatus of claim 1 wherein all of said beams share a common frequency and carry the same excitation signal.

5. The apparatus of claim 1 wherein said beamforming network divides an excitation signal for a particular beam among said array elements in accordance with a Taylor Line-Source procedure.

6. The apparatus of claim 1 wherein said beamforming network comprises a Butler network.

7. The apparatus of claim 1 further comprising said multiple element antenna array.

8. A method of exciting a multiple element antenna array to develop a desired radiation pattern comprising a plurality of spatially overlapping beams, said method comprising the steps of:

generating a plurality of excitation signals, each excitation signal corresponding to one of said plurality of beams;

phase shifting by substantially 180 degrees excitation signals of said plurality corresponding to alternating ones of said plurality of beams; and dividing each of said excitation signals among elements of said array in accordance with a Taylor Line-Source procedure to generate antenna element output signals.

9. The method of claim 8 further comprising the step of:

applying said antenna element output signals to respective elements of said array to generate said desired radiation pattern.

10. The method of claim 8 wherein said generating step comprises:

generating said plurality of excitation signals as identical signals on a common frequency.

11. The method of claim 10 wherein said generating step comprises:

generating said plurality of excitation signals wherein at least two adjacent signals are distinct and occupy a common frequency.

12. The method of claim 8 wherein said dividing step comprises feeding said excitation signals through a Butler network.

13. In a multi-user communication system, a base station for communicating with a plurality of user stations, said base station comprising:

a plurality of transmitters, each transmitter generating a distinct excitation signal to communicate with a user station of said plurality;

a plurality of exciter inputs, each exciter input accepting one of said excitation signals for a corresponding beam of said desired radiation pattern;

a beamforming network that receives each said excitation signal and generates an output signal for each element of said array so that said array outputs said desired radiation pattern; and an exciter input for every other beam of said desired radiation pattern including a substantially 180 degree phase shifter to apply a substantially 180 degree phase shift prior to input to said beamforming network to minimize interference between adjacent beams of said desired radiation pattern.

14. The base station of claim 13 wherein at least two of said excitation signals share a common frequency.

15. The base station of claim 14 wherein said base station is a paging base station.

* * * * *